United States Patent [19]

Gordin et al.

[11] 4,423,471

[45] Dec. 27, 1983

[54] MOBILE LIGHTING FIXTURE, METHOD AND BOOM

[75] Inventors: Myron K. Gordin; James L. Drost, both of Oskaloosa; Bryan L. Mydosh, Given, all of Iowa

[73] Assignee: Mycro-Group Company, Oskaloosa, Iowa

[21] Appl. No.: 418,452

[22] Filed: Sep. 15, 1982

[51] Int. Cl.[3] ..... F21V 33/00

[52] U.S. Cl. ..... 362/96; 362/61; 362/66; 362/218; 362/223; 362/250; 362/264; 362/272; 362/287; 362/294; 362/307; 362/350; 362/418; 362/419; 362/420; 362/430; 362/431

[58] Field of Search ..... 362/61, 66, 96, 218, 362/223, 250, 264, 272, 287, 294, 307, 350, 418, 419, 420, 430, 431

[56] References Cited

U.S. PATENT DOCUMENTS

Re. 30,000 5/1979 Loffler et al. ..... 362/61

4,220,981 9/1980 Koether ..... 362/431

*Primary Examiner*—Stephen J. Lechert, Jr.

*Attorney, Agent, or Firm*—Zarley, McKee, Thomte, Voorhees & Sease

[57] ABSTRACT

A mobile lighting unit which includes a plurality of lighting fixtures, each utilizing high-wattage, high-intensity lamps. The fixtures comprise a socket and hemispherical reflector assembly which are vertically and horizontally adjustably mounted to a lighting rack by an adjustable elbow member. The lamps are positioned in said fixtures so that their longitudinal axis is parallel to the light beam formed by the reflector, requiring one end of the lamp to be inserted in the socket and the other end to extend to the center of the hemispherical reflector. The lamps are cooled by pressurized air produced by a fan and transported through air tight channels in the lighting rack. The lamps are shock-dampened by mounting their socket end to a metal spring located on the interior wall of the socket and by attaching wires to the front end of the lamp, which are in turn attached to metal springs on the interior surface of the reflector. Thus, the lamp is fully shock absorber protected. The lighting rack holding the plurality of fixtures is hingedly attached to a special V-shaped boom jib which allows the rack to be tilted downward by means of a remotely controlled hydraulic cylinder without interference with the boom. The boom jib is attached to a boom which is an extensible and collapsible mast, which in turn is adjustably mounted on a mobile platform.

16 Claims, 9 Drawing Figures

MOBILE LIGHTING FIXTURE, METHOD AND BOOM

BACKGROUND OF THE INVENTION

1. Field of Invention

This invention relates to mobile lighting units, more particularly to high-wattage, high-intensity mobile and adjustable lighting units.

2. Description of Problems in the Field

The uses and applications of high-intensity mobile lighting units are numerous and diverse. Mobile lighting systems have become increasingly important in light of the development of color television, which requires large amounts of bright light to reproduce accurate colors. Other examples include nightime lighting of athletic fields, primary and background lighting for motion pictures, lighting for shows and concerts, and lighting in times of emergencies.

A good and functionally useful mobile lighting system must be designed to be strong in the following areas: compactness; efficacy (maximum usable light per watt of power consumed); daylight quality; photometric versatility: high efficiency; lightweight; ruggedness; ease of operation; compatability (no noise or static or too much heat on the subject or equipment); and economical cost of operation and maintenance balanced against other systems.

The starting point for the design of a lighting system is deciding what type or types of lamps are to be used to attain the desired light intensity. Prior portable, mobile lighting systems have utilized traditional lamps, such as incandescent, mercury vapor and any number of gas-arcing lamps, to achieve this purpose. Problems with traditional lamps is that their low intensity level requires a large number of lamps be used, their efficacy and efficiency is not optimal, and problems exist in maintaining daylight-type illuminiation, as well as dark, uneven spots on the playing field.

Recently, high-wattage metal halide lamps have been developed which significantly improve upon some of the deficiencies of standard lamps. However, these metal halide lamps, referred to as HMI lamps (which stands for hydrargyrum (mercury), medium, and iodides) have problems which have prevented their prior use in mobile lighting systems.

A primary problem with the use of HMI lamps, in any system, whether stationary or mobile, is that when used with reflectors, such an intense heat is geneated by the focused light that it may cause the lamp itself to brake from heat fatigue. This is especially true when the lamps are mounted in alignment with respect to the axis of the reflector so that an optimal amount of reflective focusing can take place. As a result, as generally used now, the high wattage HMI lamps cannot be mounted in reflectors in such a way to produce the best and most efficient focused light. In particular, HMI lamps have not been mounted along the center axis of hemispherical disc reflectors at their most efficient position because of the above mentioned problems.

Additionally, problems may be encountered with the mounting of the HMI bulbs. They are comparatively fragile. This problem is amplified considerably when using HMI lamps in portable mobile units where they are subjected to much more jostling and shock. A proper shock-dampening mounting system must maintain the exact positioning of the bulb which should not be compromised by the dampeners. To obtain maximum efficiency, particularly for mobile units, exact placement must be maintained; a misalignment of as little as a 16th of an inch may severely reduce light efficiency.

Mechanically cooling susceptible areas of the lamp to prevent breakage, presents certain inherent difficulties. The problem to be overcome is that the seals of the HMI lamps must be maintained so that they are neither too hot nor too cool. Any substantial variation on either side, must not only cool the lamps to prevent lamp breakage, but must not be so great to produce a change in the color and intensity of the light. The temperature of the seals must not exceed 280° C. to prevent failures by oxidation. The use of fans to cool the seals may result in over-cooling which would increase the color temperature of the lamp, resulting in reduction in color quality. Also, one must not use complex hardware for mobile structure which unfavorably increases the weight of the total light structure.

Finally, the factors of compactness, lightweight, ruggedness, and economy dictate that a mobile light unit should have as few light-reflector assemblies as possible, while simultaneously producing a maximum output of light.

Heretofore, the limitations of conventional lamps have prevented any significant improvement in reducing the number of lights that need to be used for the varying illumination purposes desired of a mobile lighting unit. The more lighting fixtures needed on each boom, the heavier and more cumbersome the units become, in addition to the primary problem of presenting a greater surface area and therefore a greater wind load, which presents problems with wind resistance during windy or stormy days. There is therefore a continuing need for a mobile boom structure which allows the remote tilting of the light racks to reduce the chances of damage in high winds.

It is therefore an object of this invention to provide a mobile lighting fixture, method and boom, which provides a high intensity field of light with less fixtures than previously possible.

It is a further object of this invention to provide a mobile lighting fixture, method and boom which provides universal mobile rigging which can be numerically adjusted to produce lighting qualities and quantities which match computer derived models. It is a further object of this invention to provide a mobile lighting fixture, method and boom which provides a higher intensity beam, utilizing HMI lamps, by using hemispherical dish reflectors and orienting the lamps so that the lamp long axis extends from the center of the reflector outward.

A further object of this invention is to provide a mobile lighting fixture, method and boom which has individual vertical and horizontal adjustment capabilities.

Another object of this invention is to provide a mobile lighting fixture, method and boom which resolves heat, light control, electrical and structural problems.

Another object of this invention is to provide a mobile lighting fixture, method and boom which efficiently captures and consolidates the light in individual lamps and multiple lamps.

Another object of this invention is to provide a mobile lighting fixture, method and boom whereby the lamps can be misaligned and then easily moved back to a predetermined orientation according to the desired numerically adjustable lighting qualities and quantities.

Another object of this invention is to provide a mobile lighting fixture, method and boom whereby the lamps are shock-dampened, but yet will not become misaligned, by even fractions of an inch.

Another object of this invention is to provide a mobile lighting fixture, method and boom whereby the most heat sensitive spots of the lamps are mechanically cooled and maintained at required temperatures to give maximum light beam efficiency without danger of lamp destruction.

A further object of this invention is to provide a mobile lighting fixture, method and boom wherein the fixtures are lightweight, durable, simple, and have a minimum number of parts.

A further object of this invention is to provide a mobile lighting fixture, method and boom which can adjustably tilt by means of remote control.

Another object of this invention is to provide a mobile lighting fixture, method and boom wherein the boom is extensible and collapsible and adjustable, while at the same time allowing tilting of the light rack.

Another object of the invention is to provide a mobile lighting fixture, method and boom which is easily transported, erected, and operated.

Another object of this invention is to provide a mobile light fixture, method and boom which is durable, economical, and versatile.

SUMMARY OF THE INVENTION

This invention utilizes a mobile transportable platform such as a large truck having a plurality of light fixtures mounted upon a light rack which is in turn tiltably mounted upon the end of an adjustable boom operated from the truck bed. It is especially designed and adapted for sports lighting of athletic fields.

The light fixtures are unique in that they utilize lamps being positioned so that they point directly out the center axis line of the reflector. Each light fixture is mounted upon a light rack by a vertically and horizontal adjustable elbow mounting means, allowing each fixture to be individually adjusted.

The orientation of the HMI lamps within the reflector and fixture produces a focused beam of greater beam efficiency than that of a conventional floodlight. Attendant with this intense beam are high temperatures which can tax the normally fragile lamp.

This invention utilizes a shock-dampening means to prevent breakage of the lamp. A J-shaped metal spring attaches between the inside wall of the socket and one end of the lamp. The other end of the lamp is held in a biased position by wires extending from that end to slightly curved, rectangular metal springs located along the inside of the reflector.

To keep the lamp seals cooled to a desired temperature, a static pressure fan is put in fluid communication with the lighting rack framework. The lighting rack framework comprises vertical support bars and horizontal fixture mounting bars which are hollow and in fluid communication with one another. The front seal of each lamp is cooled by tapping an air hose off of the framework and communicating this hose with a tube which extends through the reflector to a position just adjacent the seal of the front end of the lamp. The rear end of the lamp is cooled by allowing air to pass through the specially constructed elbow joint connecting the rear end of the socket with the framework. Air exit openings are located in both the reflector and socket to allow escape of the pressurized air.

A specially constructed boom jib is positioned between the lighting rack and the top end of the boom. The boom jib is basically a V-shaped superstructure which hingedly supports the lighting rack at its top end and is rigidly attached to the boom end at its lower end. A hydraulic cylinder is supported by the boom jib to facilitate the remote tilting of the lighting rack. The V-shape of the boom jib allows both upward and downward tilting of the lighting rack without interference by the boom itself. Upward tilting of the rack, very close to horizontal, is extremely advantageous in times of high wind. The wind resistance of the structure is considerably reduced, thereby reducing the chances of damage to the lighting unit. Also the jib is connected to conveniently allow re-orientation to a pre-aimed position, known to achieve maximum efficiency for good, uniform field lighting, see Gordin, COMPOSITE PHOTOMETRIC METHOD, concurrently filed and commonly assigned.

DETAILED DESCRIPTION OF THE INVENTION

Figure 1:
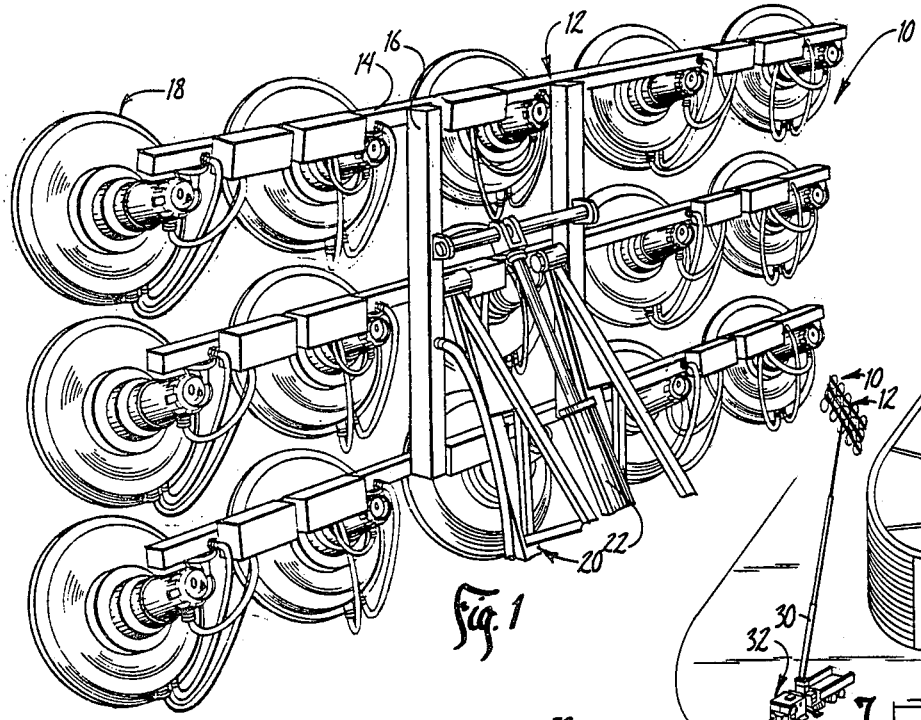
FIG. 1 is a rear perspective view of the lighting rack and upper end of the boom jib and hydraulic tilting cylinder.

In reference to the drawings, and particularly FIG. 1, there is shown a mobile lighting fixture referred to generally as 10 mounted on boom 11 in accordance with the invention. Lighting fixture 10 is mounted on a lighting rack framework 12 made up of horizontal bars 14 and vertical support bars 16, as shown. Individual lamp fixtures 18 of like design are equally spaced along horizontal bars 14 to present a unified lighting array.

A specially constructed boom jib 20 hingedly attaches to hollow vertical support bars 16 so that by operation of hydraulic cylinder 22 the entire lighting rack framework 12 may be tilted forward or backward by remote control.

Figure 2:
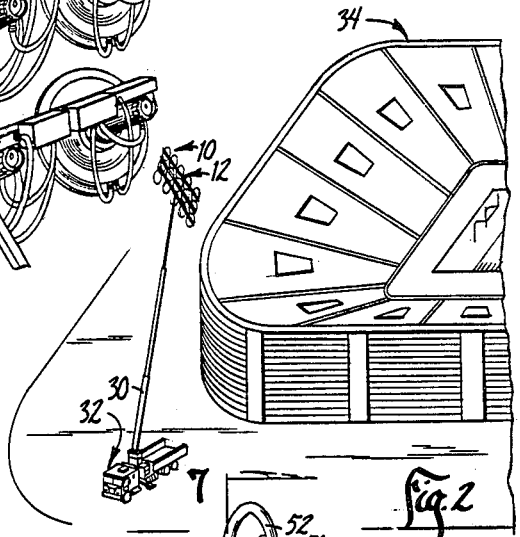
FIG. 2 is a perspective schematic of the invention in use at a football stadium.
Figure 3:
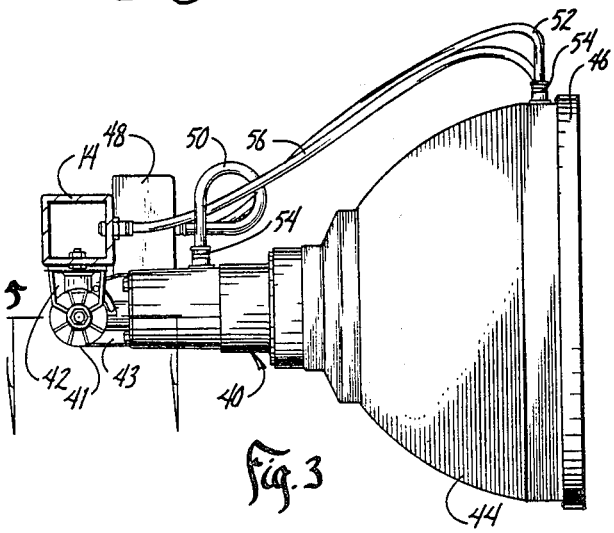
FIG. 3 is an elevated side view of one lighting fixture.
Figure 4:
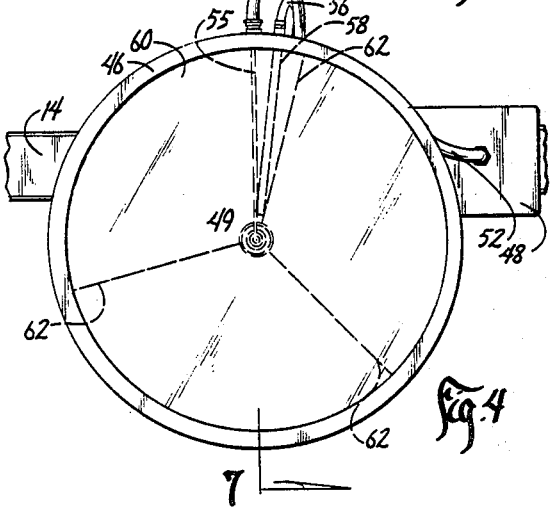
FIG. 4 is a front view of one lighting fixture.

FIG. 2 illustrates the working cooperation of the total structure. Lighting rack framework 12 is hingedly positioned upon the top end of extensible and collapsible boom 30 by means of boom jib 20, shown in full detail in FIGS. 8 and 9. The bottom of boom 30 is mounted to a mobile platform such as a truck bed 32, which includes power means and control means to move boom 30 in any direction around its attachment point to the bed of truck 32. This adjustability allows the mobile unit to be easily moved adjacent to an athletic field such as a football stadium 34 and positioned by moving boom 30 and tilting lighting rack framework 12 to produce the desired lighting effect. Socket 40 holds one end of the lamp, or bulb, and is attached to a horizontal bar 14 of lighting rack framework 12 by means of adjustable elbow joint 41, see FIG. 3 and FIG. 4.

Lamp 49 is a HMI lamp, a member of the metal-halide type, high intensity discharge (HID) lamp family. HMI stands for "hydrargyrum" (mercury), "medium", arc length and "iodides". The HMI lamps are filled with mercury and argon as the basic elements to achieve an arc discharge.

The high intensity, highly efficient, daylight quality HMI lights allow a fewer number to be used on each lighting rack to accomplish the same purpose as conventional lights. This greatly reduces weight and wind resistance of each lighting array.

Elbow joint 41 consists of two hingeable hubs 42 and 43. The outer ends of hubs 42 and 43 are attached to the bottom side of a horizontal bar 14 and the back end of socket 40, respectively. A hemispherical dish reflector 44 is mounted to the front end of socket 40 and encloses the front end of the lamp or bulb 49. A reflector rim 46 surrounds the front edge of reflector 44. Ballasts 48 to compensate for the negative resistance produced by arcing lamps, are mounted upon horizontal bars 14.

Electrical connecting wires 50 and 52 run from ballast 48 to socket 40 and the front of reflector 44 respectively, to provide electrical power to the lamp 49. Wires 50 and 52 are interfaced to the lamp fixture 18 by insulators 54.

Lamps of the type used with the present invention require high wattage electricity to operate. This produces a heat problem which is particularly troublesome at the outer ends of lamp 49, illustrated in FIG. 4.

Pressurized air is used to control the temperature around the critical areas of lamp 49. The pressurized air is supplied to the hollow interior chambers of vertical support bars 16, by a static pressure fan 194, which produces an even, constant supply of cooling air so that the temperature around the critical areas of lamp 19 can be accurately controlled within the allowable temperature range. These in turn are in fluid communication with the interior hollow passages of horizontal bars 14. The air is tapped from bars 14 by air hoses 56 which extend to the front edge of reflector 44. There hose 56 attaches to a rigid air tube 38 which extends through the side of reflector 44 to a position adjacent the front end of lamp 49. Thus, cooling pressurized air is directed to the front end of lamp 49.

Figure 5:
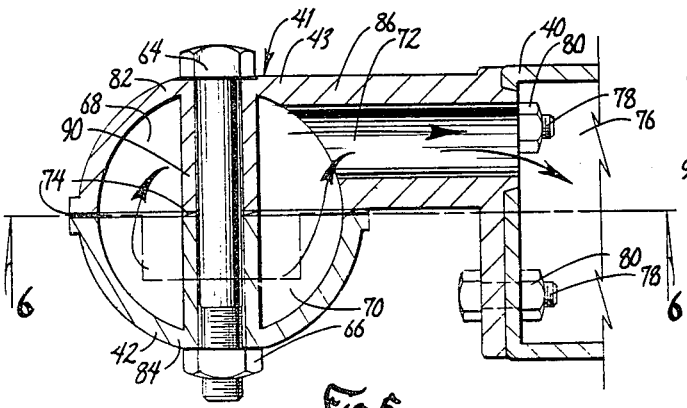
FIG. 5 is a sectional view of the elbow mounting joint taken along lines 5—5 of FIG. 3, illustrating the flow of cooling air through the joint.
Figure 6:
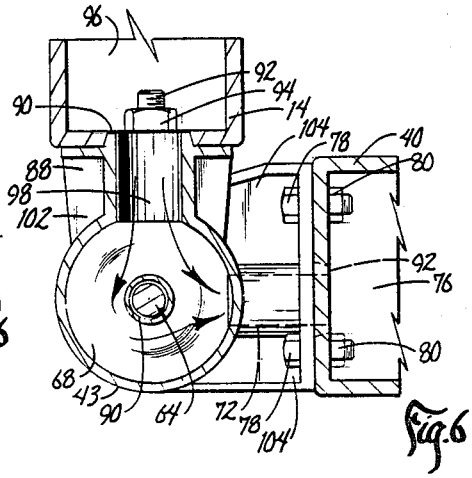
FIG. 6 is a sectional view taken along lines 6—6 of FIG. 5.

The rear end of lamp 49 is cooled by use of the special structure of elbow joint 41, shown in FIGS. 5 and 6. Hubs 42 and 43 each have a hemispherical end, the interior of which has a tubular member extending through its center. When hubs 42 and 43 are combined and secured by bolt 64 and nut 66, an interior air chamber is defined by them as at hemispherical chambers 68 and 70 which surround bolt 64.

Hub 43 has an outwardly extending leg 86 and hub 42 has an outwardly extending leg 88, both of which have an air channel extending through them. By virtue of an air tight sealing gasket 74 placed between hemispherical halves of hubs 42 and 43, the unique structure of elbow joint 41 allows air to travel from the outward open end of leg 88 through air channel 70 to chamber 70, and then to chamber 68, air channel 72 and out the outer end of piece 43. Thus, the pressurized air supplied by fan 94 has a passway to the rear end of bulb 49 through elbow joint 41. Leg 88 is mounted to an air opening 90 in horizontal bar 14 by bolts 92 and nuts 94, and leg 86 is attached to opening 92 in the rear end of socket 40 by fasteners 100.

Figure 7:
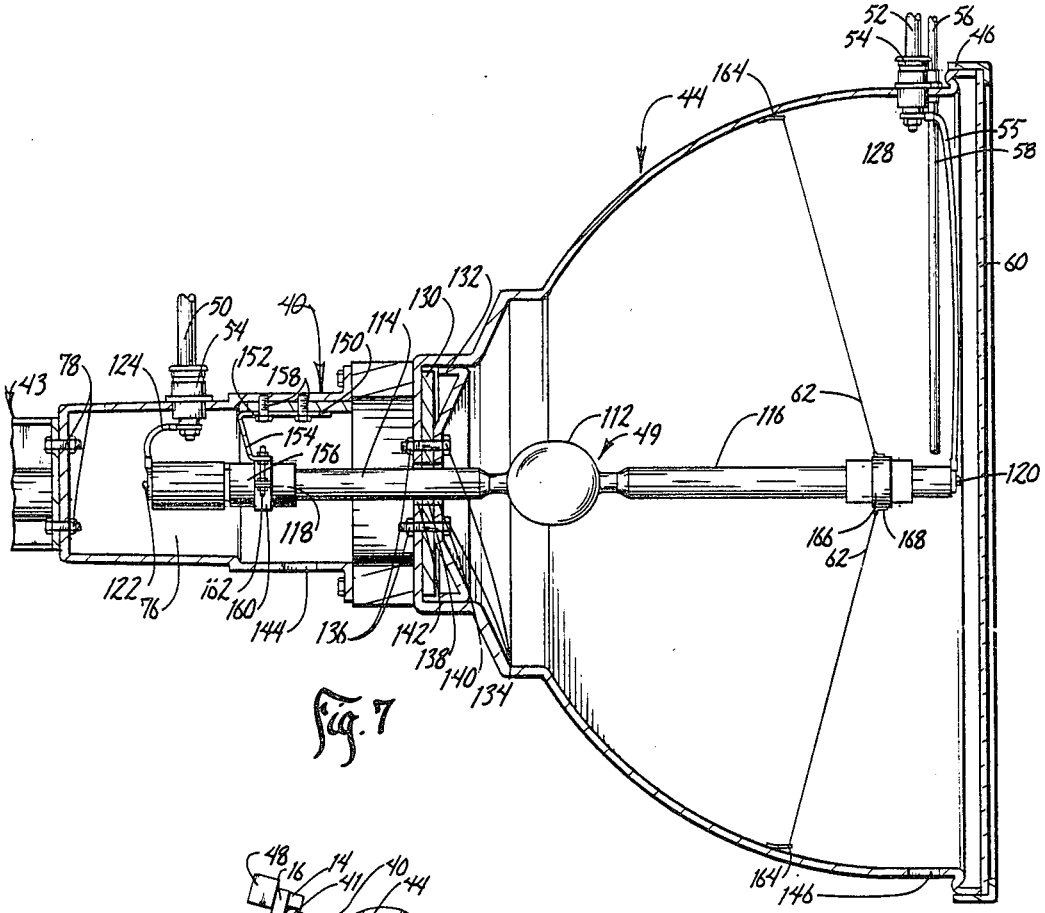
FIG. 7 is a sectional side view of the structure of one fixture, along line 7—7 of FIG. 3.

The preferred embodiment of lighting fixture 18 is shown in FIG. 7. Lamp 49 (an HMI lamp preferably) is disposed longitudinally through the fixture 18 so that rear end 114 is positioned inside socket 40, and front end 116 is positioned approximately in the center of hemispherical reflector 44. Discharge vessel 112 containing the arcing component of the lamp, is positioned at the reflective center of reflector 44. The electrical connection for lamp 49 consists of rear electrical wire 50, electrically connected to rear lead wire 124 through insulator 54 in the side of socket 40. Electrical connection 122 feeds electrical power into the rear end 114 of bulb 49.

The electrical connection to front end 116 of bulb 49 is from electrical wire 52 to front electrical lead 55 through insulator 54 in the upper side surface of reflector 44. Lead 55 is attached by fastener 120 to the very front end 116 of lamp 49. Bulb 49 passes through the interface between socket 40 and reflector 44 without contacting the structure. A small reflector 132 is attached to the rear interior surface of reflector 44 to cover the interface.

Air outlet hose 144 at the bottom of socket 40 and air outlet hole 146 at the bottom of deflector 44, allow for the escape of pressurized air after it has passed over the ends of lamp 49.

The fragile nature of lamp 49 combined with the jostling experienced by transport of the mobile lighting system, requires lamp 49 to be mounted to both absorb such shocks, and at the same time, to prevent misalignment of the bulb, once correctly positioned. Rear end 114 of lamp 49 is mounted inside of socket 40 by a J-shaped yieldable metal spring 150. Spring 150 is a generally flat, elongated metal piece having a flat end rigidly attached to the side of socket 40 by fasteners 158, a bent mid-section 154 extending acutely from flat end 150, and finally a short flat lamp end 156 which is secured to circular metal clamp 160, which surrounds rear end 114 of lamp 49. Clamp 160 is fastened to lamp end 156 by fasteners 162.

Front end 116 of lamp 49 is held in a shock-dampened position by tauntly secured wires 62 positioned between circular clamp 166 and reflector springs 164, attached to the interior surface of reflector 44. Reflector springs 164 are flat metal pieces which are slightly bent inward towards lamp 49 to provide the necessary balance of rigidity and buoyancy.

Figure 8:
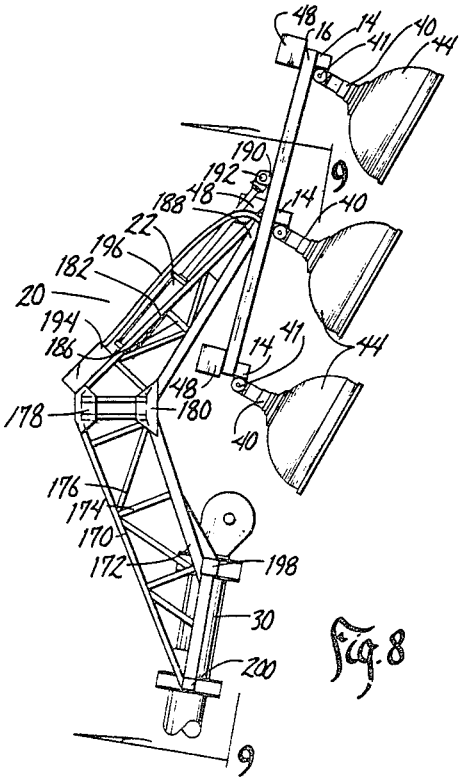
FIG. 8 is a side elevational view of the lighting rack, fixtures and boom jib as attached to the boom.
Figure 9:
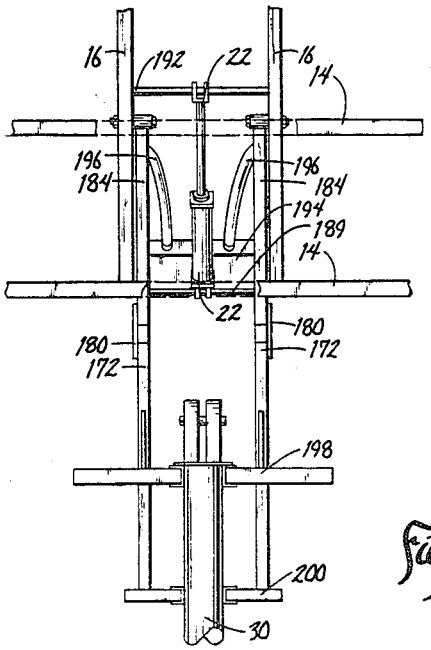
FIG. 9 is a partial view taken alone lines 9—9 of FIG. 8.

FIGS. 8 and 9, depict the structure of boom jib 20 and its attaching relationship to lighting rack framework 12. Boom jib 20 is V-shaped in configuration, its interior angle subtending a 49° arc. This permits framework 12 to be tilted approximately 32° down without coming into conflict with the boom, which would be impossible without the V-shaped boom jib 20. Likewise, boom jib 20 allows framework 12 to be tilted upward towards horizontal so that in high winds a smaller surface area is presented, thus decreasing wind resistance. V-shaped boom jib 20 includes two sets of parallel lower rails, 170 and 172, which are supported and interconnected by perpendicular cross-members 174 and diagonal cross-members 176. Rails 170 are attached at their lower ends to cross-beam 200. Rails 172 are attached at their lower ends to cross beam 198. Rails 170 extend upwardly and outwardly to middle connecting plates 178; and, rails 172 extend to middle connecting plates 180.

Two pairs of upper rails 182 and 184, are parallely spaced apart from one another, and extend from middle connection plates 178 and 180 up to hinged attachment to vertical support bars 16. Upper rails 182 extend from middle connecting plate 178 while upper rail 184 extends from middle connecting plate 180 and converges to where it meets upper rails 182 at vertical bars 16. Upper rails 182 and 184 are supported and interconnected by perpendicular cross braces 186 and diagonal cross braces 188.

Hydraulic cylinder 22 is hingedly positioned between cylinder support bar 189 and cylinder frame bar 192. Frame bar 192 in turn is attached at both sides to vertical support bars 16 via ears 190.

A static pressure fan 194 is mounted on boom jib 20 to provide pressurized air for the cooling of lamp 49, as earlier described. Air hoses 196 extend from fan 194 and are in fluid communication with both vertical support bars 16.

In operation, the mobile lighting unit is transported to the field site 34 by truck 32. Once on site, boom 30 is raised and extended so that lighting rack framework 12 is raised to the desired height. Hydraulic cylinder 22 is remotely utilized to tilt framework 12 to the desired angle. Hydraulic cylinder 22 may be utilized to tilt frame work 12 to horizontal so that wind resistance and air drag is reduced in times of high wind.

Once a power supply is connected, lamps 49 can be turned on. In order to cool lamps 49 and keep them operating correctly, fan 194 is turned on, producing a constant static pressure air supply.

The pressurized air is transmitted to the interior passageway of vertical support bar 16 of framework 12 which are in fluid communication with the hollow interiors of horizontal bars 14. The air travels through elbow joints 41 into the inner chambers of sockets 40 wherein rear end 114 of lamp 49 is cooled. The pressurized air is then allowed to exit through rear air exit opening 144. Some of the pressurized air is tapped by air hoses 56 from the air supplied to inner hollow chambers of horizontal bars 14 and transported to air tubes 58. Pressurized air is essentially blown directly upon front end 116 of lamp 49 in the interior of reflector 44. Air is also allowed to leave through front air exit opening 146 in the bottom of reflector 44.

Upon shut down of the lighting fixtures, the boom can be collapsed and the lighting unit is ready to be moved to a different location. The shock dampening system previously described prevents damage to lamps 49, or disorientation of their desired prealigned position.

It thus can be seen that the invention accomplishes at least all of the stated objectives.

We claim:

1. A lighting fixture, comprising:

(a) a hemispherical hollow reflector having a rear apex end and a front end;

(b) a socket having one open end for reception of a lamp, said socket being connected to said apex end of said reflector;

(c) a high wattage metal halide arc lamp, having front and rear ends, with said rear end being received in said open end of said socket;

(d) a vertically and horizontally adjustable mounting elbow attached to one end of said socket, and also attached to a fixture holder, (e) said lamp being positioned longitudinally along the axis of said socket for maximum beam reflection efficiency;

(f) shock dampening mounting means to mount said lamp in said socket and (g) a pressurized air system associated with said fixture for cooling the first and second ends of said lamp during operation.

2. The device of claim 1 wherein said lamp comprises a metal halide type, high-intensity discharge (HID) lamp of a HMI type with higher vapor pressure than standard HID lamps.

3. The device of claim 1 wherein a transparent lens covers the front end of said reflector.

4. The device of claim 1 wherein said mounting means comprises:

(a) a first shock-dampening means attached between said first end of said lamp and said interior of said socket; and (b) a second shock-dampening means attached between said second end of said lamp and the interior surface of said reflector.

5. The device of claim 4 wherein said first shock-dampening means comprises a J-shaped metal spring.

6. The device of claim 4 wherein said second shock-dampening means comprises:

(a) a plurality of slightly curved yieldable rectangular metal springs attached at one end to the inside surface of said reflector;

(b) a circular clamp surrounding said second end of said lamp; and (c) wire members connecting said circular member and said metal pieces in a tensioned manner so that said second end of said lamp is centered in said reflector and is biased against any shock by the metal springs.

7. The device of claim 1 wherein said pressurized air system comprises:

(a) a fan means; and (b) connecting means for transport of said pressurized air to said fixture.

8. The device of claim 7 wherein said pressurized air system further comprises:

(a) An air tube connected at one end and in fluid communication with said connecting means and extending through said reflector said other end of said air tube being open and being positioned adjacent said second end of said lamp; and (b) an air tight channel through said elbow member in fluid communication with said connecting means and in fluid communication with the interior of said socket enclosing said first end of said lamp.

9. A lighting rack for the adjustable mounting of a plurality of light fixtures upon a boom comprising:

(a) a framework having vertical support members and horizontal members for the mounting of said light fixtures;

(b) a V-shaped boom end structure having upper and lower ends, and connected at its lower end to the end of said boom, and hingedly mounted at its upper end to said vertical members of said framework, so that said framework may be tilted; and (c) means associated with V-shaped structure and said hinge for tilting said framework about said hinge.

10. The device of claim 9 wherein said framework has an air tight channel running through said vertical and horizontal members so that all said vertical and horizontal members are in sealed fluid communication with one another.

11. The device of claim 9 wherein said framework supports ballast members for each of said light fixtures.

12. The device of claim 9 wherein said framework comprises:

(a) two spaced apart members; and (b) three equally spaced apart horizontal members attached to said vertical members at points equidistant from the ends of said horizontal members.

13. The device of claim 9 wherein said means for tilting said framework comprises a hydraulic cylinder having one end mounted to said V-shaped boom end structure and the other end mounted to said vertical members of said framework.

14. The device of claim 9 wherein said V-shaped boom end structure comprises:

(a) two pairs of lower edge pieces extending parallely upward and rearwardly from the end of said boom and having a plurality of lattice work pieces interconnecting each pair of lower edge pieces;

(b) two pairs of upper edge pieces extending parallely upwardly and forwardly, each pair hingedly attached to a vertical member of said framework and having a plurality of lattice work pieces interconnecting each pair of upper edge pieces; and (c) middle side pieces connecting the upper ends of opposite pairs of lower edge pieces, the lower ends of opposite pairs of upper edge pieces.

15. The device of claim 7 wherein said pressure fan is mounted upon said V-shaped boom end structure.

16. The device of claim 9 wherein said boom comprises:

(a) a vertically extendable sectional boom;

(b) a movable platform upon which said boom is adjustably mounted; and (c) means for moving said extended boom in any direction around the pivot point on said movable platform.

* * * * *